US008978789B1

(12) United States Patent
Sani et al.

(10) Patent No.: US 8,978,789 B1
(45) Date of Patent: Mar. 17, 2015

(54) POLYCRYSTALLINE DIAMOND COMPACT INCLUDING AN AT LEAST BI-LAYER POLYCRYSTALLINE DIAMOND TABLE, METHODS OF MANUFACTURING SAME, AND APPLICATIONS THEREFOR

(75) Inventors: Mohammad N. Sani, Orem, UT (US); Alberto Castillo, Orem, UT (US)

(73) Assignee: US Synthetic Corporation, Orem, UT (US)

( * ) Notice: Subject to any disclaimer, the term of this patent is extended or adjusted under 35 U.S.C. 154(b) by 439 days.

(21) Appl. No.: 12/845,339

(22) Filed: Jul. 28, 2010

(51) Int. Cl.
*E21B 10/567* (2006.01)

(52) U.S. Cl.
USPC ..... 175/433; 175/434

(58) Field of Classification Search
USPC ..... 175/405.1, 420.2, 434, 433, 428, 426; 428/212, 332, 408, 469; 75/242
See application file for complete search history.

(56) References Cited

U.S. PATENT DOCUMENTS

| | | | |
|---|---|---|---|
| 4,268,276 | A | 5/1981 | Bovenkerk |
| 4,410,054 | A | 10/1983 | Nagel et al. |
| 4,468,138 | A | 8/1984 | Nagel |
| 4,560,014 | A | 12/1985 | Geczy |
| RE32,380 | E | 3/1987 | Wentorf, Jr. et al. |
| 4,738,322 | A | 4/1988 | Hall et al. |
| 4,811,801 | A | 3/1989 | Salesky et al. |
| 4,913,247 | A | 4/1990 | Jones |
| 5,016,718 | A | 5/1991 | Tandberg |
| 5,045,092 | A | 9/1991 | Keshavan |
| 5,092,687 | A | 3/1992 | Hall |
| 5,120,327 | A | 6/1992 | Dennis |
| 5,135,061 | A | 8/1992 | Newton, Jr. |
| 5,154,245 | A | 10/1992 | Waldenstrom et al. |
| 5,158,148 | A | 10/1992 | Keshavan |
| 5,180,022 | A | 1/1993 | Brady |
| 5,364,192 | A | 11/1994 | Damm et al. |
| 5,368,398 | A | 11/1994 | Damm et al. |
| 5,460,233 | A | 10/1995 | Meany et al. |
| 5,480,233 | A | 1/1996 | Cunningham |
| 5,544,713 | A | 8/1996 | Dennis |
| 6,009,963 | A | 1/2000 | Chaves et al. |
| 6,216,805 | B1 | 4/2001 | Lays et al. |
| 6,601,662 | B2 | 8/2003 | Matthias et al. |
| 6,793,681 | B1 | 9/2004 | Pope et al. |
| 7,493,965 | B1 | 2/2009 | Bertagnolli et al. |

(Continued)

OTHER PUBLICATIONS

U.S. Appl. No. 12/875,380, filed Sep. 3, 2010, Sani, et al.

(Continued)

*Primary Examiner* — Shane Bomar
*Assistant Examiner* — Kipp Wallace
(74) *Attorney, Agent, or Firm* — Dorsey & Whitney LLP

(57) ABSTRACT

In an embodiment, a polycrystalline diamond compact ("PDC") includes a substrate and a polycrystalline diamond ("PCD") table bonded to the substrate. The PCD table includes an upper surface. The PCD table includes a first PCD region including bonded-together diamond grains and exhibits a first diamond density. At least a portion of the first PCD region extending inwardly from the working surface is substantially free of metal-solvent catalyst. The PCD table includes an intermediate second PCD region bonded to the substrate, which is disposed between the first PCD region and the substrate. The second PCD region includes bonded-together diamond grains defining interstitial regions, with at least a portion of the interstitial regions including metal-solvent catalyst disposed therein. The second PCD region exhibits a second diamond density that is greater than that of the first diamond density of the first PCD region.

16 Claims, 7 Drawing Sheets

(56) References Cited

U.S. PATENT DOCUMENTS

| | | | | |
|---|---|---|---|---|
| 7,516,804 | B2 | 4/2009 | Vail | |
| 7,635,035 | B1 | 12/2009 | Bertagnolli et al. | |
| 2005/0257430 | A1 | 11/2005 | Fries et al. | |
| 2006/0272571 | A1 | 12/2006 | Cho | |
| 2007/0046120 | A1 | 3/2007 | Cooley et al. | |
| 2007/0187153 | A1 | 8/2007 | Bertagnolli | |
| 2008/0023231 | A1 | 1/2008 | Vail | |
| 2008/0142267 | A1 | 6/2008 | Griffin et al. | |
| 2008/0179109 | A1* | 7/2008 | Belnap et al. | 175/432 |
| 2008/0302579 | A1 | 12/2008 | Keshavan et al. | |
| 2009/0158670 | A1 | 6/2009 | Vail | |
| 2010/0104874 | A1 | 4/2010 | Yong et al. | |
| 2010/0192473 | A1* | 8/2010 | Keshavan | 51/307 |
| 2010/0294571 | A1 | 11/2010 | Belnap et al. | |
| 2011/0031034 | A1 | 2/2011 | DiGiovanni et al. | |
| 2011/0036643 | A1* | 2/2011 | Belnap et al. | 175/434 |
| 2011/0056141 | A1 | 3/2011 | Miess et al. | |
| 2011/0073380 | A1 | 3/2011 | DiGiovanni | |
| 2011/0132666 | A1* | 6/2011 | DiGiovanni et al. | 175/428 |
| 2011/0132667 | A1* | 6/2011 | Smallman et al. | 175/428 |
| 2011/0262295 | A1 | 10/2011 | Voronov et al. | |
| 2011/0271603 | A1* | 11/2011 | Voronin et al. | 51/295 |

OTHER PUBLICATIONS

U.S. Appl. No 12/875,380, Oct. 30, 2012, Office Action.
U.S. Appl. No. 14/197,891, filed Mar. 5, 2014, Sani, et al.
U.S. Appl. No. 12/875,380, Jul. 18, 2013, Office Action.
U.S. Appl. No. 12/875,380, Dec. 5, 2013, Notice of Allowance.
U.S. Appl. No. 12/875,380, Apr. 2, 2014, Issue Notification.
U.S. Appl. No. 12/875,380, Mar. 15, 2013, Office Action.

* cited by examiner

POLYCRYSTALLINE DIAMOND COMPACT INCLUDING AN AT LEAST BI-LAYER POLYCRYSTALLINE DIAMOND TABLE, METHODS OF MANUFACTURING SAME, AND APPLICATIONS THEREFOR

BACKGROUND

Wear-resistant, polycrystalline diamond compacts ("PDCs") are utilized in a variety of mechanical applications. For example, PDCs are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller-cone drill bits and fixed-cutter drill bits. A PDC cutting element typically includes a superabrasive diamond layer commonly known as a diamond table. The diamond table is formed and bonded to a substrate (e.g. a cemented carbide) using a high-pressure/high-temperature ("HPHT") process. The PDC cutting element may be brazed directly into a preformed pocket, socket, or other receptacle formed in a bit body. The substrate may often be brazed or otherwise joined to an attachment member, such as a cylindrical backing. A rotary drill bit typically includes a number of PDC cutting elements connected to the bit body. It is also known that a stud carrying the PDC may be used as a PDC cutting element when mounted to a bit body of a rotary drill bit by press-fitting, brazing, or otherwise securing the stud into a receptacle formed in the bit body.

Conventional PDCs are normally fabricated by placing a substrate into a container with a volume of diamond particles positioned on a surface of the substrate. A number of such containers may be loaded into an HPHT press. The substrate(s) and volume(s) of diamond particles are then processed under HPHT conditions in the presence of a catalyst material that causes the diamond particles to bond to one another to form a matrix of bonded diamond grains defining a polycrystalline diamond ("PCD") table. The catalyst material is often a metal-solvent catalyst (e.g., cobalt, nickel, iron, or alloys thereof) that is used for promoting intergrowth of the diamond particles.

In one conventional approach, a constituent of the cemented-carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a catalyst to promote intergrowth between the diamond particles, which results in formation of a matrix of bonded diamond grains having diamond-to-diamond bonding therebetween, with interstitial regions between the bonded diamond grains being occupied by the solvent catalyst.

Despite the availability of a number of different PDCs, manufacturers and users of PDCs continue to seek PDCs that exhibit improved toughness, wear resistance, thermal stability, or combinations of the foregoing.

SUMMARY

Embodiments of the invention relate to PDCs including a PCD table exhibiting an at least bi-layer PCD structure that enhances the leachability thereof, drill bits using such PDCs, and methods of manufacture. In an embodiment, a PDC includes a substrate and a PCD table bonded to the substrate. The PCD table includes an upper surface. The PCD table further includes a first PCD region comprising bonded-together diamond grains. The first PCD region exhibits a first diamond density. At least a portion of the first PCD region that extends inwardly from the upper surface is substantially free of metal-solvent catalyst. The PCD table further includes an intermediate second PCD region bonded to the substrate, which is disposed between the first PCD region and the substrate. The intermediate second PCD region includes bonded-together diamond grains defining interstitial regions, with at least a portion of the interstitial regions including metal-solvent catalyst disposed therein. The intermediate second PCD region exhibits a second diamond density that is greater than that of the first diamond density of the first PCD region.

In an embodiment, a method of fabricating a PDC includes forming an assembly including a first region including diamond particles, a substrate, an intermediate second region disposed between the substrate and the first region. The intermediate second region includes a mixture including diamond particles and one or more $sp^2$-carbon-containing additives. The method further includes subjecting the assembly to an HPHT process to sinter the diamond particles of the first region and the intermediate second region in the presence of a metal-solvent catalyst so that a PCD table is formed that bonds to the substrate. The PCD table includes a first PCD region formed at least partially from the first region and the metal-solvent catalyst, and a second PCD region disposed between the first PCD region and the substrate. The second PCD region is formed at least partially from the second intermediate region and the metal-solvent catalyst. The method additionally includes leaching the metal-solvent catalyst from at least a portion of the first PCD region to form an at least partially leached region.

Other embodiments include applications utilizing the disclosed PDCs in various articles and apparatuses, such as rotary drill bits, bearing apparatuses, wire-drawing dies, machining equipment, and other articles and apparatuses.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical elements or features in different views or embodiments shown in the drawings.

DETAILED DESCRIPTION

Embodiments of the invention relate to PDCs including a PCD table exhibiting an at least bi-layer PCD structure that enhances the leachability thereof, drill bits using such PDCs, and methods of manufacture. The disclosed PDCs may also be used in a variety of other applications, such as, machining equipment, bearing apparatuses, and other articles and apparatuses.

Figure 1A:
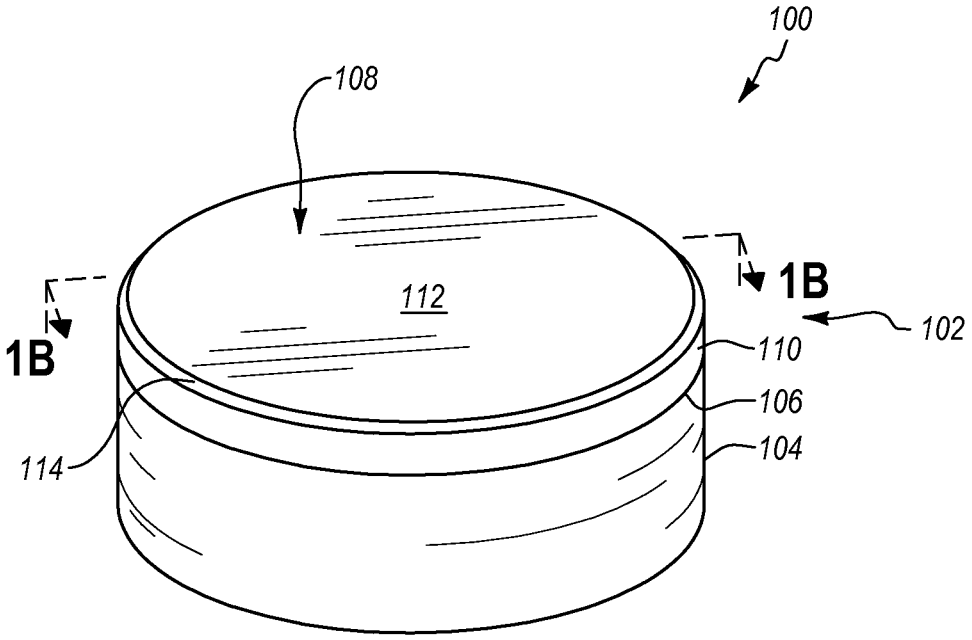
FIG. 1A is an isometric view of a PDC according to an embodiment of the invention.
Figure 1B:
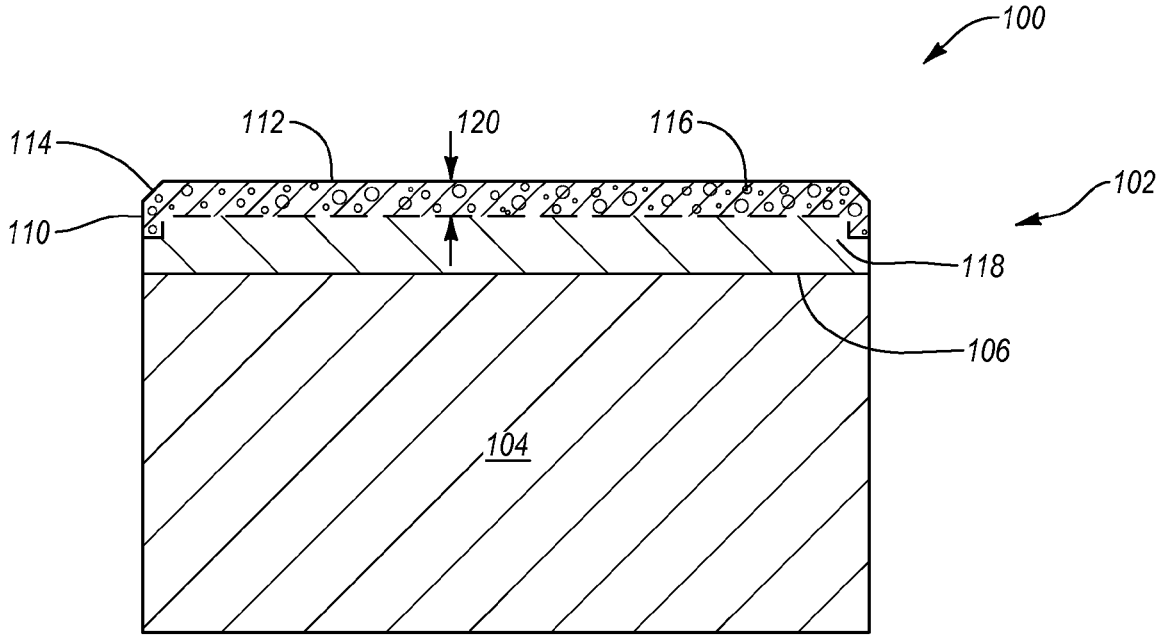
FIG. 1B is a cross-sectional view of the PDC shown in FIG. 1A taken along line 1B-1B thereof.

FIGS. 1A and 1B are isometric and cross-sectional views, respectively, of an embodiment of a PDC 100. The PDC 100 includes a PCD table 102 and a substrate 104 having an interfacial surface 106 that is bonded to the PCD table 102. For example, the substrate 104 may comprise a cemented carbide substrate, such as tungsten carbide, tantalum carbide, vanadium carbide, niobium carbide, chromium carbide, titanium carbide, or combinations of the foregoing carbides cemented with iron, nickel, cobalt, or alloys of the foregoing metals. In an embodiment, the cemented carbide substrate may comprise a cobalt-cemented tungsten carbide substrate. Although the interfacial surface 106 is illustrated as being substantially planar, the interfacial surface 106 may exhibit a selected nonplanar topography.

The PCD table 102 includes a plurality of directly bonded-together diamond grains exhibiting diamond-to-diamond bonding (e.g., $sp^3$ bonding) therebetween. As will be discussed in more detail below, the PCD table 102 may be formed on the substrate 104 (i.e., integrally formed with the substrate 104) by HPHT sintering diamond particles on the substrate 104. The plurality of directly bonded-together diamond grains define a plurality of interstitial regions. The PCD table 102 defines an upper surface 108 and peripheral surface 110. In the illustrated embodiment, the upper surface 108 includes a substantially planar major surface 112 and a peripherally-extending chamfer 114 that extends between the peripheral surface 110 and the major surface 112. The upper surface 108 and/or the peripheral surface 110 may function as a working surface that contacts a formation during drilling operations.

Referring specifically to FIG. 1B, the PCD table 102 includes a leached first PCD region 116 remote from the substrate 104 that includes the major surface 112, the chamfer 114, and may include a portion of the peripheral surface 110. The first PCD region 116 extends inwardly to a selected maximum leach depth from the major surface 112. The PCD table 102 also includes a second PCD region 118 adjacent to and bonded to the interfacial surface 106 of the substrate 104. Metal-solvent catalyst infiltrated from the substrate 104 during HPHT processing occupies the interstitial regions of the second PCD region 116. For example, the metal-solvent catalyst may be cobalt from a cobalt-cemented tungsten carbide substrate that infiltrated into the second PCD region 118.

The first PCD region 116 has been treated leached to deplete the metal-solvent catalyst therefrom that used to occupy the interstitial regions between the bonded diamond grains of the first PCD region 116. The leaching may be performed in a suitable acid (e.g., aqua regia, nitric acid, hydrofluoric acid, or combinations thereof) so that the first PCD region 116 is substantially free of the metal-solvent catalyst. Generally, the maximum leach depth 120 may be about 50 μm to about 900 μm, such as 50 μm to about 400 μm. For example, the maximum leach depth 120 for the leached second region 122 may be about 300 μm to about 425 μm, about 350 μm to about 400 lam, about 350 μm to about 375 μm, about 375 μm to about 400 μm, or about 500 μm to about 650 μm. The maximum leach depth 120 may be measured inwardly from at least one of the major surface 112, the chamfer 114, or the peripheral surface 110. In some embodiments, the leach depth measured inwardly from the chamfer 114 and/or the peripheral surface 110 may be about 5% to about 30% less than the leach depth measured from major surface 112.

At least the second PCD region 118 has been fabricated in the presence of a one or more $sp^2$-carbon-containing additives (e.g., graphite, graphene, fullerenes, ultra-dispersed diamond particles, or combinations of the foregoing) to impart a thermal stability to the second PCD region 118, a wear resistance to the second PCD region 118, a diamond density to the second PCD region 118, or combinations of the foregoing that is enhanced relative to the overlying first PCD region 116 prior to and/or after the leaching. For example, a diamond density of the second PCD region 118 may be about 1% to about 10% greater than a diamond density of the first PCD region 116, such as about 1% to about 5% or about 5% to about 10%. In some embodiments, part of the leached first PCD region 116 may have been fabricated in the presence of one or more $sp^2$-carbon-containing additives.

Despite all or most of the first PCD region 116 not being fabricated in the presence of a one or more $sp^2$-carbon-containing additives (e.g., graphite), the underlying more thermally-stable second PCD region 118 imparts sufficient thermal stability to the overall PCD table 102. Additionally, by leaching the first PCD region 116, the thermal-stability of the first PCD region 116 is improved, even if it is shallowly leached. Furthermore, by not fabricating the first PCD region 116 in the presence of one or more sp-carbon-containing additives, the leachability of the metal-solvent catalyst from the first PCD region 116 may be substantially greater than the underlying second PCD region 118 at least partially due to the lower diamond density of the first PCD region 116.

Figure 2:
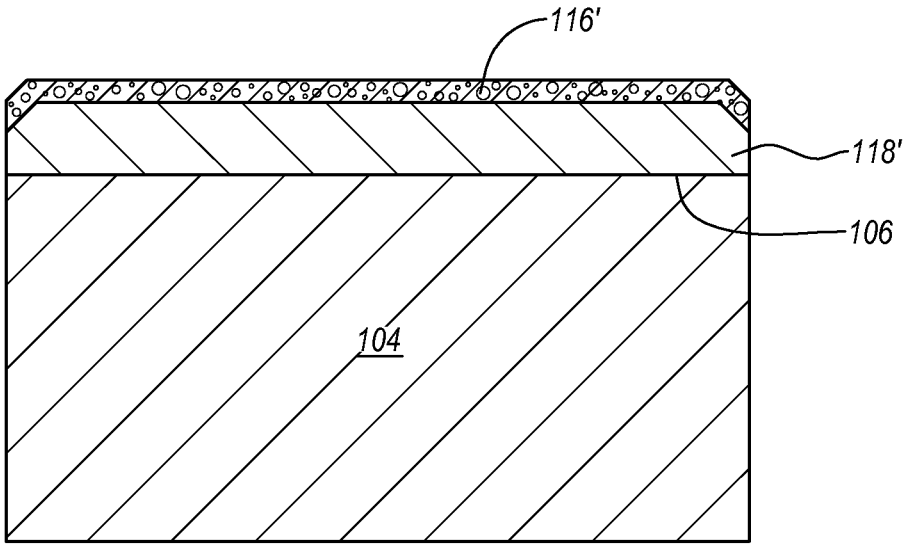
FIG. 2 is a cross-sectional view of a PDC according to another embodiment.

Referring to the cross-sectional view in FIG. 2, in another embodiment, a first PCD region 116' (which may be configured like region 116 described above) may contour an underlying second PCD region 118' (which may be configured like region 118 described above). In such an embodiment, the thickness of the first PCD region 116' may be made relatively thinner than that of the first PCD region 116 shown in FIG. 1B while still providing a sufficient large coverage of the working region.

Figure 3A:
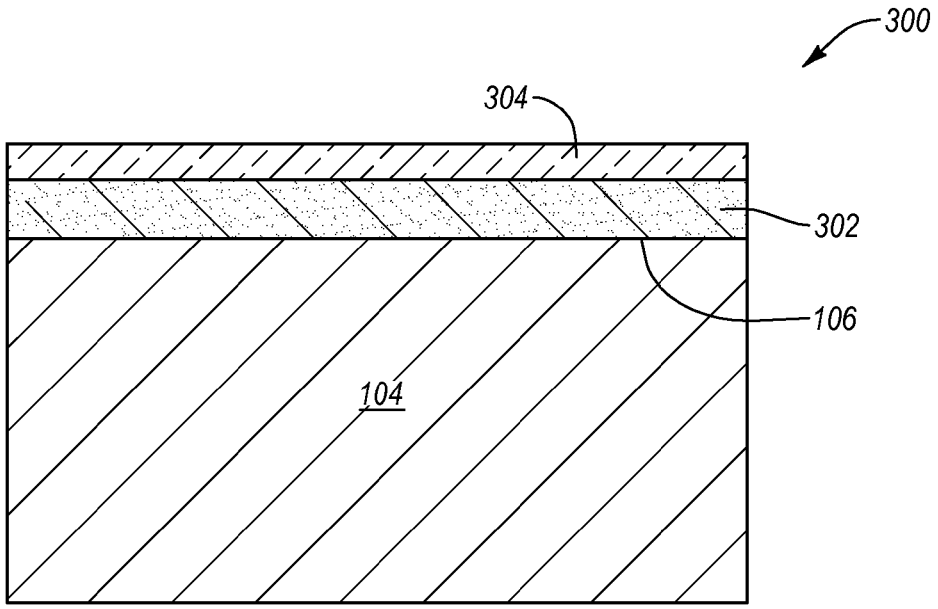
FIGS. 3A-3D are cross-sectional views at various stages during the manufacture of the PDC shown in FIGS. 1A and 1B according to an embodiment.

FIGS. 3A-3D are cross-sectional views at various stages during the manufacture of the PDC 100 shown in FIGS. 1A and 1B according to an embodiment. Referring to FIG. 3A, an assembly 300 may be formed by disposing one or more layers 302 including a mixture of diamond particles and one or more $sp^2$-carbon-containing additives adjacent to the interfacial surface 106 of the substrate 104 and further adjacent to one or more layers 304 including diamond particles. After HPHT processing of the assembly 300, the one or more layers 302 ultimately form part of the second PCD region 118 shown in FIG. 1B and the one or more layers 304 form part of the first PCD region 116.

In some embodiments, the one or more layers 304 may further include a plurality of sacrificial particles to improve the leachability of the metal-solvent catalyst from the first PCD region 116. For example, the sacrificial particles may be present in the one or more layers 304 in a concentration of greater than 0 wt % to about 15 wt %, about 1.0 wt % to about 10 wt %, about 1.0 wt % to about 5 wt %, about 1.5 wt % to about 2.5 wt %, about 1.0 wt % to about 2.0 wt %, or about 2.0 wt %, with the balance being the diamond particles. It is currently believed that relatively low amounts of the sacrificial particles (e.g., less than about 5 wt %, less than about 3 wt %, or less than about 2 wt %) increases accessibility for leaching the PCD table without significantly affecting the wear properties of the PCD table. The sacrificial particles may exhibit an average particle size (e.g., an average diameter) of about submicron to about 10 μm, about submicron to about 5 μm, less than about 5 μm, about submicron to about 2 μm, about submicron to about 1 μm, less than about 1 μm, or nanometer in dimensions such as about 10 nm to about 100 nm.

The sacrificial particles may be made from any material that exhibits a melting temperature greater than that of a melting temperature of the metal-solvent catalyst used to catalyze formation of PCD from the diamond particles and that is leachable from the PCD so formed via a leaching process. The sacrificial particles may be selected from particles made from metals, alloys, carbides, and combinations thereof that exhibit a melting temperature greater than that of a melting temperature of the metal-solvent catalyst used to catalyze formation of PCD from the diamond particles and that is leachable from the PCD so formed via a leaching process. For example, the sacrificial particles may be selected from particles made of refractory metals (e.g., niobium, molybdenum, tantalum, tungsten, rhenium, hafnium, and alloys thereof), other metals or alloys exhibiting a melting temperature greater than that of a melting temperature of the metal-solvent catalyst used to catalyze formation of PCD from the diamond particles and that is leachable from the PCD so formed via a leaching process, and combinations thereof. As another example, the sacrificial particles may be selected from particles of titanium, vanadium, chromium, iron, zirconium, niobium, molybdenum, hafnium, tantalum, tungsten, rhenium, any other metal or alloy that exhibits a melting temperature greater than that of a melting temperature of the metal-solvent catalyst used to catalyze formation of PCD from the diamond particles and that is leachable from the PCD so formed via a leaching process, alloys of any of the foregoing metals, carbides of any of the foregoing metals or alloys, and combinations of the foregoing. For example, in a more specific embodiment, the sacrificial particles may be selected from tungsten particles and/or tungsten carbide particles.

The plurality of diamond particles of the one or more layers 302, 304 may each exhibit one or more selected sizes. The one or more selected sizes may be determined, for example, by passing the diamond particles through one or more sizing sieves or by any other method. In an embodiment, the plurality of diamond particles may include a relatively larger size and at least one relatively smaller size. As used herein, the phrases "relatively larger" and "relatively smaller" refer to particle sizes determined by any suitable method, which differ by at least a factor of two (e.g., 40 μm and 20 μm). In various embodiments, the plurality of diamond particles may include a portion exhibiting a relatively larger size (e.g., 100 μm, 90 μm, 80 μm, 70 μm, 60 μm, 50 μm, 40 μm, 30 μm, 20 μm, 15 μm, 12 μm, 10 μm, 8 μm) and another portion exhibiting at least one relatively smaller size (e.g., 30 μm, 20 μm, 10 μm, 15 μm, 12 μm, 10 μm, 8 μm, 4 μm, 2 μm, 1 μm, 0.5 μm, less than 0.5 μm, 0.1 μm, less than 0.1 μm). In an embodiment, the plurality of diamond particles may include a portion exhibiting a relatively larger size between about 40 μm and about 15 μm and another portion exhibiting a relatively smaller size between about 12 μm and about 2 μm. Of course, the plurality of diamond particles may also include three or more different sizes (e.g., one relatively larger size and two or more relatively smaller sizes), without limitation.

In some embodiments, an average diamond particle size of the one or more layers 304 may be less than an average diamond particle size of the one or more layers 302. In such an embodiment, the first PCD region 116 may exhibit an average diamond grain size that is less than an average diamond grain size of the second PCD region 118. In other embodiments, an average diamond particle size of the one or more layers 304 may be greater than an average diamond particle size of the one or more layers 302. In such an embodiment, the first PCD region 116 may exhibit an average sintered diamond grain size that is greater than an average sintered diamond grain size of the second PCD region 118.

The one or more $sp^2$-carbon-containing additives present in the one or more layers 302 may be selected from one or more $sp^2$-carbon containing materials, such as graphite particles, graphene, fullerenes, ultra-dispersed diamond particles, or combinations of the foregoing. All of the foregoing $sp^2$-carbon-containing additives at least partially include $sp^2$ hybridization. For example, graphite, graphene (i.e., a one-atom-thick planar sheet of $sp^2$-bonded carbon atoms that form a densely-packed honeycomb lattice), and fullerenes contain $sp^2$ hybridization for the carbon-to-carbon bonds, while ultra-dispersed diamond particles contain a diamond core with $sp^3$ hybridization and an $sp^2$-carbon shell. The non-diamond carbon present in the one or more $sp^2$-carbon-containing additives substantially converts to diamond during the HPHT fabrication process discussed in more detail below. The presence of the $sp^2$-carbon-containing material during the fabrication of the PCD table 102 is believed to enhance the diamond density of the second PCD region 118 of the PCD table 102, the thermal stability of the second PCD region 118 of the PCD table 102, the wear resistance of the second PCD region 118 of the PCD table 102, or combinations of the foregoing relative to the first PCD region 116. For any of the disclosed one or more $sp^2$-carbon-containing additives, the one or more $sp^2$-carbon-containing additives may be selected to be present in a mixture of the one or more layers 304 with the plurality of diamond particles in an amount of greater than 0 wt % to about 20 wt %, such as about 1 wt % to about 15 wt %, about 2 wt % to about 10 wt %, about 3 wt % to about 6 wt %, about 3 wt % to about 8 wt %, about 4.5 wt % to about 5.5 wt %, or about 5 wt %.

The graphite particles employed for the non-diamond carbon may exhibit an average particle size of about 1 μm to about 20 μm (e.g., about 1 μm to about 15 μm or about 1 μm to about 3 μm). In some embodiments, the graphite particles may be sized fit into interstitial regions defined by the plurality of diamond particles. However, in other embodiments, graphite particles that do not fit into the interstitial regions defined by the plurality of diamond particles may be used because the graphite particles and the diamond particles may be crushed together so that the graphite particles fit into the interstitial regions. According to various embodiments, the graphite particles may be crystalline graphite particles, amorphous graphite particles, synthetic graphite particles, or combinations thereof. The term "amorphous graphite" refers to naturally occurring microcrystalline graphite. Crystalline graphite particles may be naturally occurring or synthetic. Various types of graphite particles are commercially available from Ashbury Graphite Mills of Kittanning, Pa.

An ultra-dispersed diamond particle (also commonly known as a nanocrystalline diamond particle) is a particle generally composed of a PCD core surrounded by a metastable carbon shell. Such ultra-dispersed diamond particles may exhibit a particle size of about 1 nm to about 50 nm and, more typically, of about 2 nm to about 20 nm. Agglomerates of ultra-dispersed diamond particles may be between about 2 nm to about 200 nm. Ultra-dispersed diamond particles may be formed by detonating trinitrotoluene explosives in a chamber and subsequent purification to extract diamond particles or agglomerates of diamond particles with the diamond particles generally composed of a PCD core surrounded by a metastable shell that includes amorphous carbon and/or carbon onion (i.e., closed shell $sp^2$ nanocarbons). Ultra-dispersed diamond particles are commercially available from ALIT Inc. of Kiev, Ukraine. The metastable shells of the ultra-dispersed diamond particles may serve as a non-diamond carbon source.

One common form of fullerenes includes 60 carbon atoms arranged in a geodesic dome structure. Such a carbon structure is termed a "Buckminsterfullerene" or "fullerene," although such structures are also sometimes referred to as "buckyballs." Fullerenes are commonly denoted as $C_n$ fullerenes (e.g., n=24, 28, 32, 36, 50, 60, 70, 76, 84, 90, or 94) with "n" corresponding to the number of carbon atoms in the "complete" fullerene structure. Furthermore, elongated fullerene structures may contain millions of carbon atoms, forming a hollow tube-like structure just a few atoms in circumference. These fullerene structures are commonly known as carbon "nanotubes" or "buckytubes" and may have single or multi-walled structures. 99.5% pure $C_{60}$ fullerenes are commercially available from, for example, MER Corporation, of Tucson, Ariz.

The thickness of the one or more layers 302 may be about 5 to about 25 times greater than a thickness of the one or more layers 304, such as about 10 to about 25 or about 15 to about 20 times greater than the thickness of the one or more layers 304. For example, the thickness of the one or more layers 304 may be about 100 μm to about 1000 μm, such as about 100 μm to about 500 μm or about 150 μm to about 300 μm.

Figure 3B:
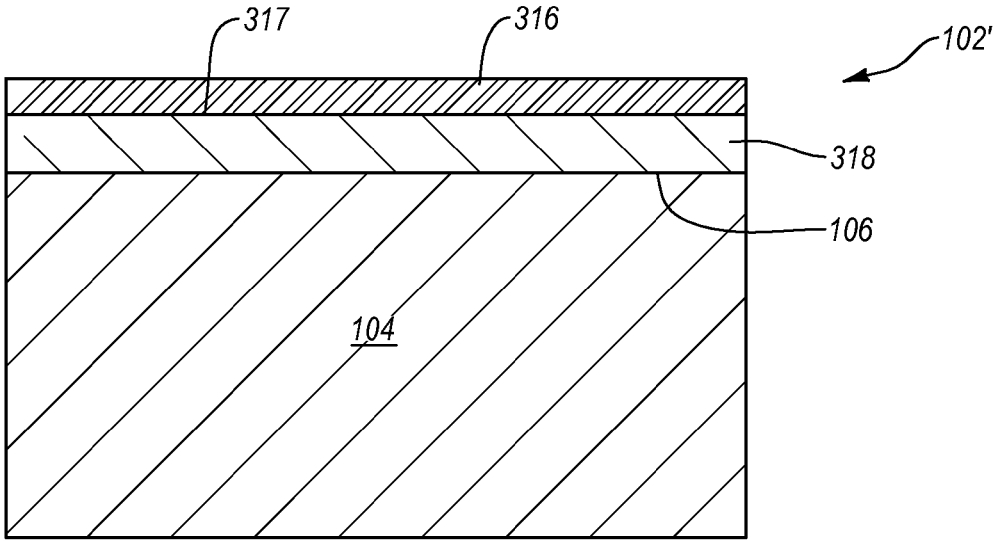

The assembly 300 including the substrate 104 and the one or more layers 302, 304 may be placed in a pressure transmitting medium, such as a refractory metal can embedded in pyrophyllite or other pressure transmitting medium. The pressure transmitting medium, including the assembly 300 enclosed therein, may be subjected to an HPHT process using an ultra-high pressure press to create temperature and pressure conditions at which diamond is stable. The temperature of the HPHT process may be at least about 1000° C. (e.g., about 1200° C. to about 1600° C.) and the pressure of the HPHT process may be at least 4.0 GPa (e.g., about 5.0 GPa to about 12 GPa or about 7.5 GPa to about 11 GPa) for a time sufficient to sinter the diamond particles to form a PCD table 102' that is shown in FIG. 3B. For example, the pressure of the HPHT process may be about 7 GPa to about 10 GPa and the temperature of the HPHT process may be about 1150° C. to about 1550° C. (e.g., about 1200° C. to about 1500° C.). The foregoing pressure values employed in the HPHT process refer to the pressure in the pressure transmitting medium that transfers the pressure from the ultra-high pressure press to the assembly 300.

Upon cooling from the HPHT process, the PCD table 102' becomes bonded (e.g., metallurgically) to the substrate 104. The PCD table 102' includes a first PCD region 316 formed from the one or more layers 304 and the infiltrated metal-solvent catalyst and a second PCD region 318 formed from the one or more layers 302 and the infiltrated metal-solvent catalyst, with a boundary 317 between the first PCD region 316 and the second PCD region 318.

The thickness of the second PCD region 318 may be about 1 to about 15 times greater than a thickness of the first PCD region 316, such as about 1 to about 8 times. For example, the thickness of the first PCD region 316 may be about 100 μm to about 1000 μm, such as about 100 μm to about 500 μm or about 150 μm to about 300 μm.

During the HPHT process, metal-solvent catalyst from the substrate 104 may be liquefied and may infiltrate into the diamond particles of the one or more layers 302, 304 of diamond particles. The infiltrated metal-solvent catalyst functions as a catalyst that catalyzes formation of directly bonded-together diamond grains from the diamond particles to form the PCD table 102'. Also, the $sp^2$-carbon-containing material of the one or more $sp^2$-carbon-containing additives present in the one or more layers 302, such as graphite, graphene, fullerenes, the shell of the ultra-dispersed diamond particles, or combinations of the foregoing may be substantially converted to diamond during the HPHT process. The PCD table 102' is comprised of a plurality of directly bonded-together diamond grains, with the infiltrated metal-solvent catalyst disposed interstitially between the bonded diamond grains.

In other embodiments, the metal-solvent catalyst may be mixed with the diamond particles of the one or more layers 302 and the diamond particles and the one or more $sp^2$-carbon-containing additives of the one or more layers 304. In other embodiments, the metal-solvent catalyst may be infiltrated from a thin disk of metal-solvent catalyst disposed between the one or more layers 302 and the substrate 104.

Figure 3C:
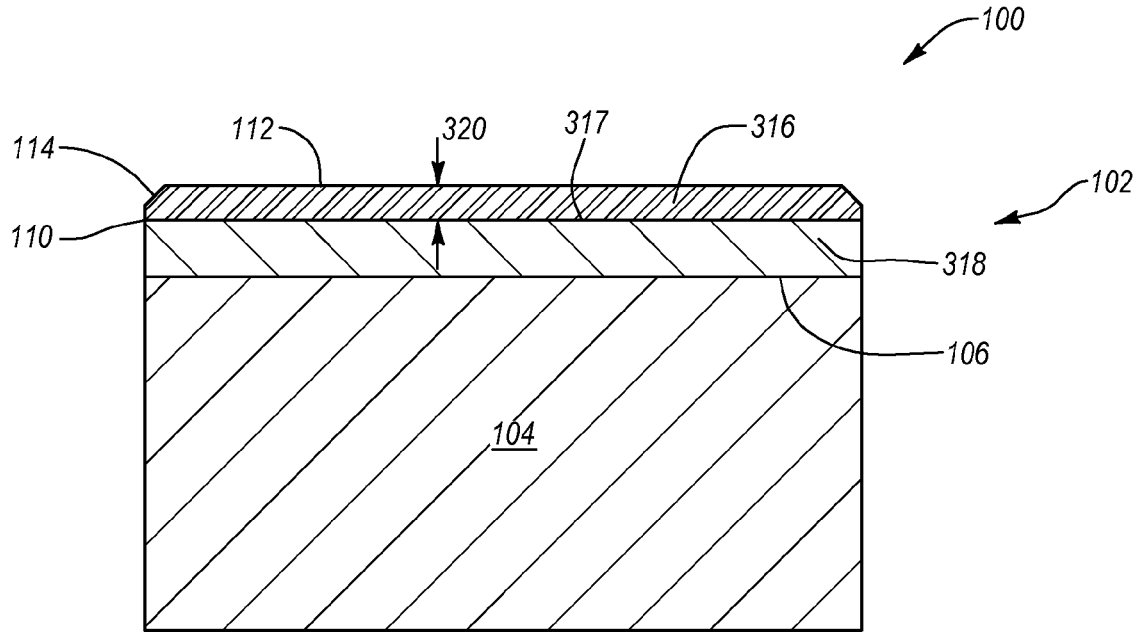

Referring to FIG. 3C, the PCD table 102' may be subjected to a planarization process, such as lapping, to planarize an upper surface of the PCD table 102' and form the major surface 112. A grinding process may be used to form the chamfer 114 in the PCD table 102' before or after the planarization process. The planarized and chamfered PCD table 102' is represented in FIGS. 1A, 1B, and 3C as the PCD table 102. The peripheral surface 110 may be defined by grinding the PCD table 102' using a centerless abrasive grinding process or other suitable process before or after the planarization process and/or forming the chamfer 114.

After forming the major surface 112 and the chamfer 114, the PCD table 102 may be leached in a suitable acid to form the leached first PCD region 116 (FIG. 1B). For example, the acid may be aqua regia, nitric acid, hydrofluoric acid, or combinations thereof. Because the first PCD region 116 was not fabricated in the presence of one or more $sp^2$-carbon-containing additives and may include sacrificial particles, the leachability of the first PCD region 116 is substantially greater than that of the second PCD region 118.

Figure 3D:
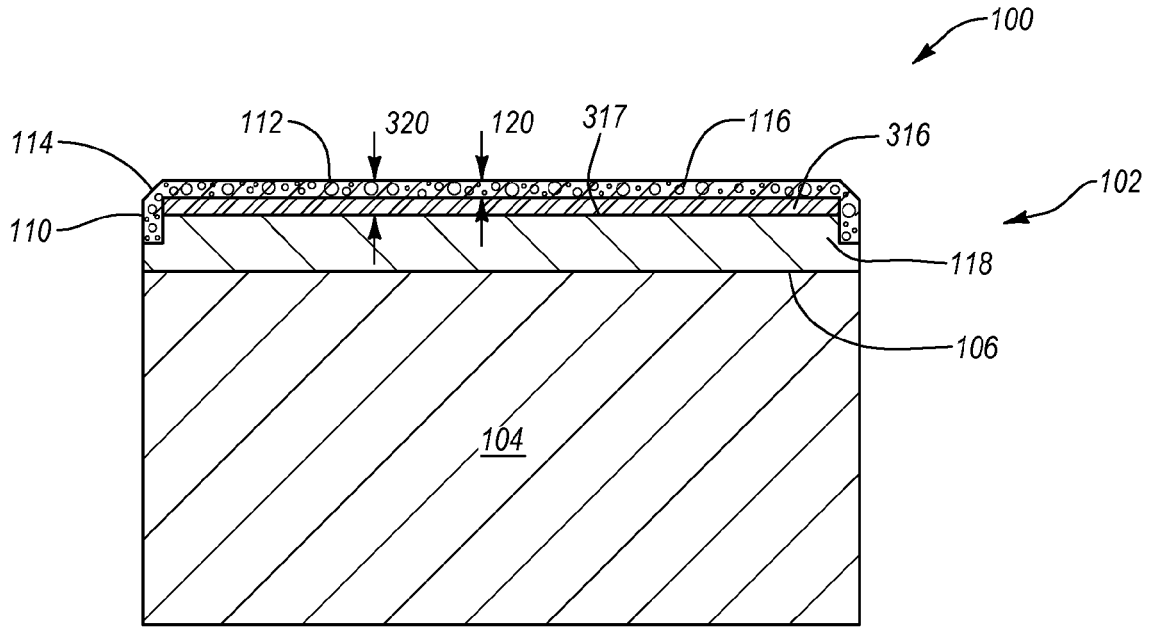

In some embodiments, substantially the entire first PCD region 316 is leached. In other embodiments, the maximum leach depth 120 of the first PCD region 116 (FIG. 1B) may be less than a maximum thickness 320 of the first PCD region 316. In further embodiments, the leached first PCD region 116 shown in FIG. 1B may extend into the second PCD region 318 shown in FIG. 3C. For example, FIG. 3D is a cross-sectional view of the structure shown in FIG. 3C in which the PCD table 102 shown in FIG. 3C is leached so that the leached first PCD region 116 extends into the second PCD region 118 and only part of the first PCD region 316 is leached, with the boundary 317 shown between the remaining first PCD region 316 and the second PCD region 318. However, in other embodiments, the leaching may be performed so that the first PCD region 116 is formed only from the first PCD region 316 shown in FIG. 3C.

Although the methods described with respect to FIGS. 3A-3D are related to integrally forming the PCD table 102 with the substrate 104, in other embodiments, the PCD table may be preformed in a first HPHT process and bonded to a new substrate in a second HPHT process. For example, in an embodiment, the PCD table 102 shown in FIGS. 1A and 1B may be separated from the substrate 104 by removing the substrate 104 via grinding, electro-discharge machining, or another suitable technique. The separated PCD table 102 may be immersed in any of the disclosed leaching acids to substantially remove all of the metal-solvent catalyst used to form the PCD table 102 or the metal-solvent catalyst may be removed by any other suitable technique. After leaching, the at least partially leached PCD table (i.e., a pre-sintered PCD table) may be placed adjacent to a new substrate 104, with the region fabricated with the one or more $sp^2$-carbon-containing additives positioned remote from the new substrate 104. The at least partially leached PCD table is bonded to the new substrate 104 in a second HPHT process that may employ HPHT process conditions that are the same or similar to that used to form the PCD table 102.

In the second HPHT process, a cementing constituent from the new substrate 104 (e.g., cobalt from a cobalt-cemented tungsten carbide substrate) infiltrates into the at least partially leached PCD table. Upon cooling, the infiltrant from the new substrate 104 forms a strong metallurgical bonded with the infiltrated PCD table. In some embodiments, the infiltrant may be at least partially removed from the infiltrated PCD table of the new PDC in a manner similar to the way the PCD table 102 is leached in FIG. 3 to enhance thermal stability.

In other embodiments, the PCD table 102 may be fabricated to be freestanding (i.e., not on a substrate) in a first HPHT process, leached, bonded to a new substrate 104 in a second HPHT process, and, if desired, leached after bonding to the new substrate 104.

Figure 4A:
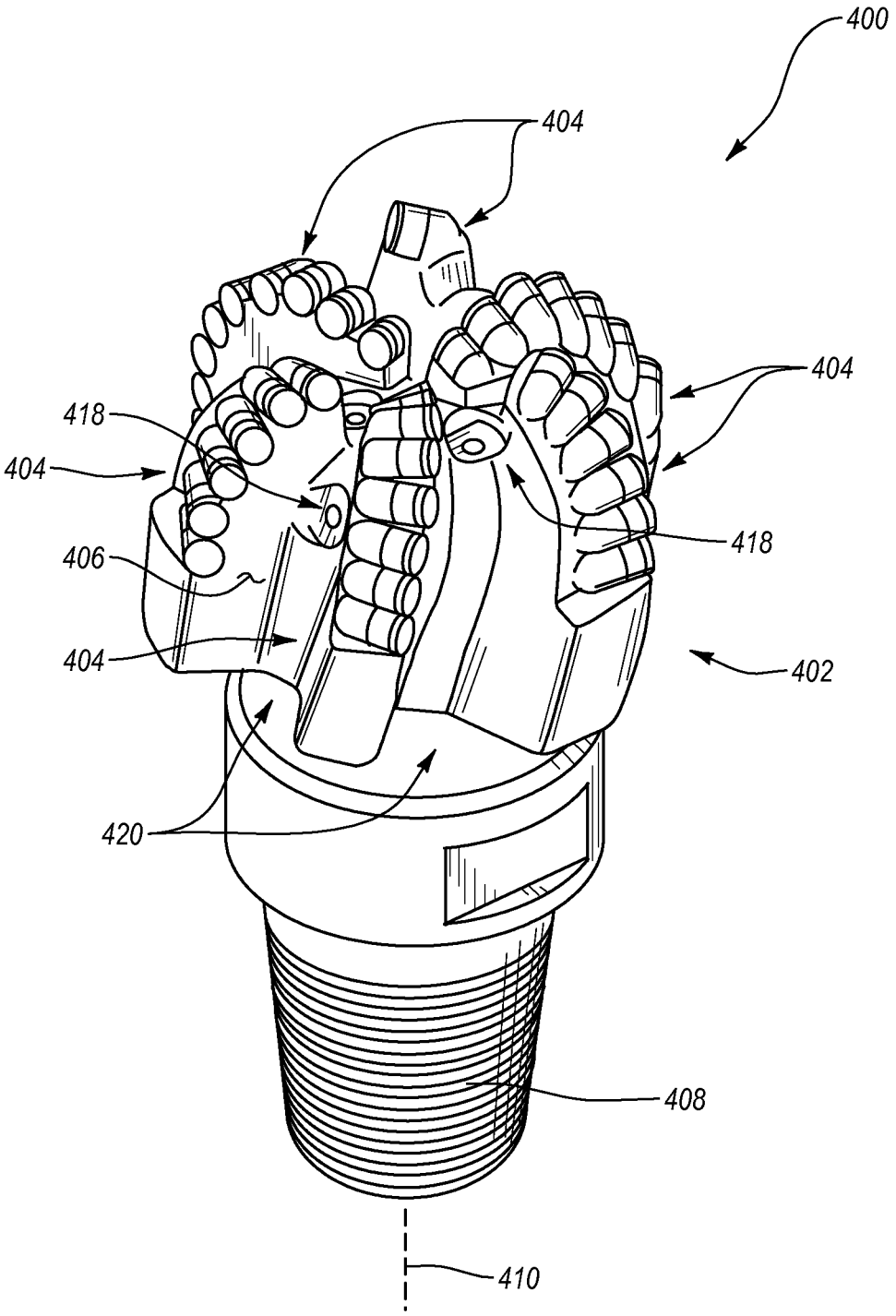
FIG. 4A is an isometric view of an embodiment of a rotary drill bit that may employ one or more of the disclosed PDC embodiments.
Figure 4B:
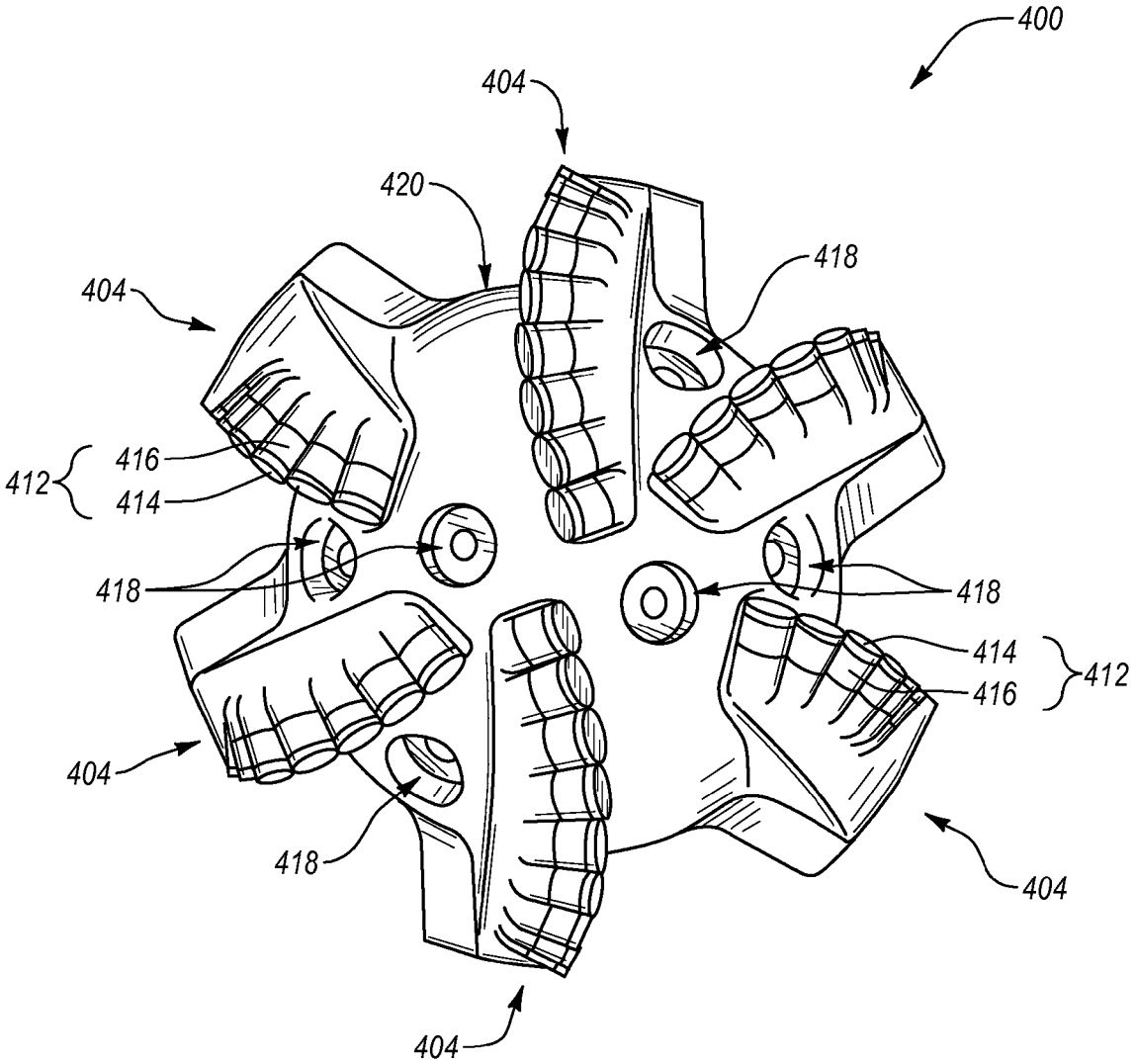
FIG. 4B is a top elevation view of the rotary drill bit shown in FIG. 4A.

FIG. 4A is an isometric view and FIG. 4B is a top elevation view of an embodiment of a rotary drill bit 400 that may employ one or more of the disclosed PDC embodiments. The rotary drill bit 400 comprises a bit body 402 that includes radially- and longitudinally-extending blades 404 having leading faces 406, and a threaded pin connection 408 for connecting the bit body 402 to a drilling string. The bit body 402 defines a leading end structure for drilling into a subterranean formation by rotation about a longitudinal axis 410 and application of weight-on-bit. At least one PDC cutting element, configured according to any of the previously described PDC embodiments, may be affixed to the bit body 402 by brazing, press-fitting, or other suitable technique. Each of a plurality of PDC cutting elements 412 is secured to the blades 404 of the bit body 402. If desired, in some embodiments, a number of the cutting element assemblies 412 may be conventional in construction. Also, circumferentially adjacent blades 404 define so-called junk slots 420 therebetween. Additionally, the rotary drill bit 400 includes a plurality of nozzle cavities 418 for communicating drilling fluid from the interior of the rotary drill bit 400 to the cutting element assemblies 412.

FIGS. 4A and 4B merely depict one embodiment of a rotary drill bit that employs at least one PDC fabricated and structured in accordance with the disclosed embodiments, without limitation. The rotary drill bit 400 is used to represent any number of earth-boring tools or drilling tools, including, for example, core bits, roller-cone bits, fixed-cutter bits, eccentric bits, bicenter bits, reamers, reamer wings, or any other downhole tool including PDCs, without limitation.

The PDCs disclosed herein (e.g., the PDC 100 shown in FIG. 1A) may also be utilized in applications other than cutting technology. For example, the disclosed PDC embodiments may be used in wire-drawing dies, bearings, artificial joints, inserts, cutting elements, and heat sinks. Thus, any of the PDCs disclosed herein may be employed in an article of manufacture including at least one PCD element PDC.

Thus, the embodiments of PDCs disclosed herein may be used on any apparatus or structure in which at least one conventional PDC is typically used. For example, in one embodiment, a rotor and a stator (i.e., a thrust bearing apparatus) may each include a PDC (e.g., the PDC 100 shown in FIG. 1A) according to any of the embodiments disclosed herein and may be operably assembled to a downhole drilling assembly. U.S. Pat. Nos. 4,410,054; 4,560,014; 5,364,192; 5,368,398; and 5,480,233, the disclosure of each of which is incorporated herein, in its entirety, by this reference, disclose subterranean drilling systems within which bearing apparatuses utilizing PDCs disclosed herein may be incorporated. The embodiments of PDCs disclosed herein may also form all or part of heat sinks, wire dies, bearing elements, cutting elements, cutting inserts (e.g., on a roller cone type drill bit), machining inserts, or any other article of manufacture as known in the art. Other examples of articles of manufacture that may use any of the PDCs disclosed herein are disclosed in U.S. Pat. Nos. 4,811,801; 4,268,276; 4,468,138; 4,738,322; 4,913,247; 5,016,718; 5,092,687; 5,120,327; 5,135,061; 5,154,245; 5,180,022; 5,460,233; 5,544,713; and 6,793,681, the disclosure of each of which is incorporated herein, in its entirety, by this reference.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be opened ended and have the same meaning as the word "comprising" and variants thereof (e.g., "comprise" and "comprises").

What is claimed is:

1. A polycrystalline diamond compact, comprising:

a polycrystalline diamond body including an upper cutting surface, the polycrystalline diamond body further including:

a first polycrystalline diamond region comprising bonded-together diamond grains exhibiting a first average grain size, the first polycrystalline diamond region exhibiting a first thermal stability and a first diamond density, the first polycrystalline diamond region extending inwardly from the upper cutting surface; and a second polycrystalline diamond region disposed adjacent to the first polycrystalline diamond region and defining a lowermost surface spaced from the upper cutting surface, the second polycrystalline diamond region formed partially from one or more $sp^2$-carbon-containing additives, the second polycrystalline diamond region comprising bonded-together diamond grains defining interstitial regions and exhibiting a second average grain size greater than the first average grain size of the first polycrystalline diamond region, at least a portion of the interstitial regions including metal-solvent catalyst disposed therein, the second polycrystalline diamond region exhibiting a second thermal stability greater than that of the first thermal stability of the first polycrystalline diamond region and a second diamond density greater than that of the first diamond density of the first polycrystalline diamond region.

2. The polycrystalline diamond compact of claim 1 wherein the second diamond density is about 1 to about 5 percent greater than the first diamond density.

3. The polycrystalline diamond compact of claim 1 wherein the first polycrystalline diamond region exhibits a first thickness and the intermediate second polycrystalline diamond region exhibits a second thickness that is about 1 to about 10 times greater than the first thickness.

4. The polycrystalline diamond compact of claim 1 wherein the first polycrystalline diamond region exhibits a first thickness and the intermediate second polycrystalline diamond region exhibits a second thickness that is about 1 to about 8 times greater than the first thickness.

5. The polycrystalline diamond compact of claim 1 wherein the first polycrystalline diamond region defines a chamfered edge surface of the polycrystalline diamond body.

6. The polycrystalline diamond compact of claim 1 wherein the first polycrystalline diamond region of the polycrystalline diamond body extends inwardly from the upper cutting surface to a depth of about 50 μM to about 200 μm.

7. A rotary drill bit, comprising:

a bit body including a leading end structure configured to facilitate drilling a subterranean formation; and a plurality of cutting elements mounted to the blades, at least one of the cutting elements including:

a polycrystalline diamond body including an upper cutting surface, the polycrystalline diamond body further including:

a first polycrystalline diamond region comprising bonded-together diamond grains exhibiting a first average grain size, the first polycrystalline diamond region exhibiting a first thermal stability and a first diamond density, the first polycrystalline diamond region extending inwardly from the upper cutting surface; and a second polycrystalline diamond region disposed adjacent to the first polycrystalline diamond region and defining a lowermost surface spaced from the upper cutting surface, the second polycrystalline diamond region formed partially from one or more $sp^2$-carbon-containing additives, the second polycrystalline diamond region comprising bonded-together diamond grains defining interstitial regions and exhibiting a second average grain size greater than the first average grain size of the first polycrystalline diamond region, at least a portion of the interstitial regions including metal-solvent catalyst disposed therein, the second polycrystalline diamond region exhibiting a second thermal stability greater than that of the first thermal stability of the first polycrystalline diamond region and a second diamond density greater than that of the first diamond density of the first polycrystalline diamond region.

8. A polycrystalline diamond compact, comprising:

a substrate; and a polycrystalline diamond table bonded to the substrate, the polycrystalline diamond table including an upper surface, the polycrystalline diamond table further including, a first polycrystalline diamond region comprising bonded-together diamond grains exhibiting a first average grain size, the first polycrystalline diamond region exhibiting a first thermal stability and a first diamond density, the first polycrystalline diamond region extending inwardly from the upper surface; and an intermediate second polycrystalline diamond region bonded to the substrate, the intermediate second polycrystalline diamond region disposed between the first polycrystalline diamond region and the substrate, the intermediate second polycrystalline diamond region formed partially from one or more $sp^2$-carbon-containing additives, the intermediate second polycrystalline diamond region comprising bonded-together diamond grains defining interstitial regions and exhibiting a second average grain size greater than the first average grain size of the first polycrystalline diamond region, at least a portion of the interstitial regions including metal-solvent catalyst disposed therein, the intermediate second polycrystalline diamond region exhibiting a second thermal stability that is greater than that of the first thermal stability of the first polycrystalline diamond region and a second diamond density greater than that of the first diamond density of the first polycrystalline diamond region.

9. The polycrystalline diamond compact of claim 8 wherein the second diamond density is about 1 to about 5 percent greater than the first diamond density.

10. The polycrystalline diamond compact of claim 8 wherein the second diamond density is about 5 to about 10 percent greater than the first diamond density.

11. The polycrystalline diamond compact of claim 1 wherein the one or more $sp^2$-carbon-containing additives include graphite, graphene, ultra-dispersed diamond particles, fullerenes, or combinations thereof.

12. The polycrystalline diamond compact of claim 8 wherein the one or more $sp^2$-carbon-containing additives include graphite, graphene, ultra-dispersed diamond particles, fullerenes, or combinations thereof.

13. The polycrystalline diamond compact of claim 8 wherein the first polycrystalline diamond region exhibits a first thickness and the intermediate second polycrystalline diamond region exhibits a second thickness that is about 1 to about 8 times greater than the first thickness.

14. The polycrystalline diamond compact of claim 8 wherein the first polycrystalline diamond region defines a chamfered edge surface of the polycrystalline diamond table.

15. The polycrystalline diamond compact of claim 8 wherein the substrate includes a cemented carbide substrate.

16. The polycrystalline diamond compact of claim 8 wherein the first polycrystalline diamond region of the polycrystalline diamond table extends inwardly from the upper cutting surface to a depth of about 50 μm to about 200 μm.

* * * * *

UNITED STATES PATENT AND TRADEMARK OFFICE

CERTIFICATE OF CORRECTION

PATENT NO. : 8,978,789 B1
APPLICATION NO. : 12/845339
DATED : March 17, 2015
INVENTOR(S) : Sani et al.

It is certified that error appears in the above-identified patent and that said Letters Patent is hereby corrected as shown below:

In the Claims

In Column 11, Claim 6, Line 7, delete "50 μM to about 200 μm." and insert -- 50 μm to about 200 μm. --, therefor.

Signed and Sealed this
Fourteenth Day of July, 2015

Michelle K. Lee

Michelle K. Lee
*Director of the United States Patent and Trademark Office*